US008595904B2

(12) United States Patent
Klementowicz, III et al.

(10) Patent No.: US 8,595,904 B2
(45) Date of Patent: Dec. 3, 2013

(54) DISPOSABLE DOUBLE LOCK RESTRAINT SYSTEM

(75) Inventors: Nicholas Klementowicz, III, Hillsborough, NJ (US); John A. Dapkins, Jr., Bloomsbury, NJ (US)

(73) Assignee: Jersey Tactical Corp., Lopatcong, NJ (US)

( * ) Notice: Subject to any disclaimer, the term of this patent is extended or adjusted under 35 U.S.C. 154(b) by 276 days.

(21) Appl. No.: 12/655,958

(22) Filed: Jan. 11, 2010

(65) Prior Publication Data

US 2011/0167880 A1 Jul. 14, 2011

(51) Int. Cl.
*E05B 75/00* (2006.01)

(52) U.S. Cl.
USPC ..... 24/16 PB; 24/17 AP; 128/879; 70/16

(58) Field of Classification Search
USPC ..... 24/16 PB, 17 AP, 35.5 P; 70/16; 206/223; 128/879; 248/74.3
See application file for complete search history.

(56) References Cited

U.S. PATENT DOCUMENTS

| | | | | | |
|---|---|---|---|---|---|
| 3,739,429 | A * | 6/1973 | Kohke | 24/16 PB |
| 4,071,023 | A * | 1/1978 | Gregory | 128/878 |
| 4,149,298 | A * | 4/1979 | Forest | 24/16 PB |
| 4,665,588 | A * | 5/1987 | Nakano | 24/16 PB |
| 4,705,245 | A * | 11/1987 | Osada | 248/74.3 |
| 4,805,856 | A * | 2/1989 | Nicoli et al. | 248/74.3 |
| 4,910,831 | A * | 3/1990 | Bingold | 24/16 PB |
| 5,146,654 | A | 9/1992 | Caveney et al. | 24/16 PB |
| 5,159,728 | A | 11/1992 | Bingold | 24/16 PB |
| 5,193,251 | A | 3/1993 | Fortsch | 24/16 PB |
| 5,193,254 | A | 3/1993 | Geisinger | 24/484 |
| 5,356,417 | A * | 10/1994 | Golds | 606/151 |
| 5,443,155 | A * | 8/1995 | Robinson | 206/223 |
| 5,513,421 | A | 5/1996 | Wells | 24/16 PB |
| 5,651,376 | A * | 7/1997 | Thompson | 128/878 |
| 5,797,404 | A | 8/1998 | Stanchin, II | 128/869 |
| 6,105,908 | A * | 8/2000 | Kraus | 248/74.3 |
| 6,151,761 | A * | 11/2000 | Thompson | 24/16 PB |
| 6,332,248 | B1 * | 12/2001 | Daniggelis et al. | 24/16 PB |
| 6,507,979 | B1 * | 1/2003 | Thompson | 24/16 PB |
| 6,539,589 | B2 * | 4/2003 | Thompson | 24/16 PB |
| 6,616,107 | B1 * | 9/2003 | Hargreaves | 248/68.1 |
| 7,131,168 | B2 * | 11/2006 | Pangallo | 24/16 PB |
| 7,360,744 | B2 * | 4/2008 | Kwilosz | 248/74.3 |
| 7,774,905 | B2 * | 8/2010 | Geiger | 24/16 PB |
| 7,926,767 | B2 * | 4/2011 | Saltenberger | 248/74.3 |
| 2002/0104196 | A1 * | 8/2002 | Geiger | 24/16 PB |
| 2002/0148077 | A1 * | 10/2002 | Thompson | 24/16 PB |
| 2003/0088948 | A1 * | 5/2003 | Cook | 24/16 PB |
| 2004/0139583 | A1 * | 7/2004 | Wendle | 24/16 PB |
| 2006/0243004 | A1 * | 11/2006 | Johnson et al. | 70/16 |
| 2006/0272367 | A1 * | 12/2006 | Kriesel | 70/16 |
| 2007/0234524 | A1 * | 10/2007 | Witt | 24/16 PB |

(Continued)

*Primary Examiner* — Robert J Sandy
*Assistant Examiner* — Rowland D Do
(74) *Attorney, Agent, or Firm* — Ernest D. Buff; Ernest D. Buff & Assoc LLC

(57) ABSTRACT

A disposable handcuff system restrains a person's wrists. The system has a flexible tie comprising a locking head, an elongated, substantially planar strap extending from the locking head having a through passageway, and a locking sleeve. The locking head and the locking sleeve have stops that permit the end of the strap to be readily inserted through the passageway and the locking sleeve, but inhibit withdrawal of the strap after it has been tightened around the wrists of the subject.

7 Claims, 3 Drawing Sheets

(56) References Cited

U.S. PATENT DOCUMENTS

2008/0244874 A1* 10/2008 Chiorboli ..... 24/16 PB
2009/0077773 A1* 3/2009 Harrington et al. ..... 24/16 PB
2009/0113675 A1* 5/2009 Saltenberger ..... 24/16 PB
2009/0205379 A1* 8/2009 Williams ..... 70/16
2010/0269548 A1* 10/2010 Harrington ..... 70/16
2011/0131768 A1* 6/2011 Watson ..... 24/16 PB

* cited by examiner

DISPOSABLE DOUBLE LOCK RESTRAINT SYSTEM

BACKGROUND OF THE INVENTION

1. Field of the Invention

The present invention relates to a disposable restraint system; and more particularly to a disposable system adapted for use when restraining the hands and/or feet of a person such as a prisoner detained by law enforcement personnel.

2. Description of Related Art

Pursuant to their lawful duties, law enforcement, military, and security personnel are routinely confronted with the need to detain and physically restrain certain persons. Security measures are taken during the detention for the sake of safety and order; at a minimum, the detainee's wrists are normally secured in handcuffs. In some instances, the detainee's ankles are also secured.

Conventional metal handcuffs and leg irons or chains have long been used for these security functions, but they suffer from a number of detriments that are especially apparent when a large number of persons are arrested or otherwise must be detained during a short period of time.

Such situations may arise during riot control or other law enforcement situations, or military operations, wherein multiple suspects must be restrained, often in a short period of time. In connection with the operation of jails and prisons, it is sometimes necessary to restrain large numbers of inmates during disorders or to move them within a facility. Such facilities are also required to have contingency plans for dealing with large scale emergencies or disasters that require evacuating a large number of people housed in the facility or portion thereof. An emergency such as a fire, flood, tornado, or the like, may occasion the need to rapidly place a large number in restraints so they can be safely yet securely moved. In many instances, the appropriate restraint may include both handcuffing each individual and securing a number of persons together. Such a practice is often denoted as gang chaining.

Conventional metal handcuffs are expensive, heavy, and cumbersome to operate. A key is required for their removal. Typically, it is not feasible for an individual patrol officer to carry enough sets of handcuffs to cope with all foreseeable operational situations.

Conventional handcuffs also present logistical difficulties. Prisoners are commonly handcuffed when they are transported in a vehicle from one location to another. For example, custody is frequently transferred from one authority to another, as when a prisoner is transferred after being convicted from a county jail to a state prison. In such circumstances, handcuffs applied at the first facility must be removed after arrival at the second facility. The specific key needed to unlock the handcuffs must be available at the destination, and the handcuffs must be returned to the original owner for reuse. A comparable problem can arise during mass arrests, in which the officer who initially applies the handcuffs to a given suspect is not present later when the handcuffs are to be removed after the suspect has been transported to a jail or other such facility, or even to a new holding location.

The use of disposable handcuffs has been proposed to address some of the foregoing practical and logistical problems. Many forms of disposable handcuffs are based on the technology of cable ties. These devices were originally developed to secure plural electrical wires or similarly shaped items disposed along a common path into an orderly bundle, which can either be freestanding or attached to a support, such as a building structural element.

Generally stated, cable ties are made of plastic or polymeric materials and comprise a strap, cord, or band having a free end that depends from a locking head. A cable tie is installed by encircling the free end around the wires to be bundled (and optionally, a building structural element as well). Then the free end is inserted through an aperture in the locking head. The locking head and aperture include a mechanism that cooperatively engages the strap unidirectionally and irreversibly, meaning that once the free end is inserted a given distance into the aperture, it cannot be withdrawn. The free end is drawn up enough to tighten the encircling band to adequately secure the bundle. The cable tie can be removed, but only by cutting the band.

A similar structure can also be applied to the wrists or ankles of a detainee, thereby serving as a handcuff mechanism. See, e.g., U.S. Pat. No. 5,193,254 to Geisinger. Because cable ties are relatively inexpensive, widely available, and can be removed by cutting them using conventional hand tools without the need for any special tool or key, some of the foregoing problems of traditional metal handcuffs are overcome.

However, it has been found that a conventional cable tie employed as a handcuff by forming it into a single loop or a single twisted loop encircling both wrists of a detainee suffers from significant problems. To be effective, handcuffs must be applied tightly enough to prevent a detainee from wriggling free. Yet society demands that restraint devices not be applied so tightly that they cut into the skin, impair circulation or nerve function, or otherwise cause internal or external injury to the detainee. In practice, it has been difficult to reliably achieve this balance with single-strap handcuffs.

A form of handcuff that employs a cable tie-like single strap in a different configuration is provided by U.S. Pat. No. 5,797,404 to Stanchin, which is incorporated herein in the entirety by reference thereto. FIG. 1 depicts an exemplary handcuff of the type disclosed by the Stanchin patent. This handcuff can be assembled by first inserting the free end of the strap into the locking head to form a single loop, then slipping the loop through a ring to form two adjacent sub-loops. The FIG. 1 handcuff is applied by first placing one of the detainee's wrists in each of the sub-loops. It is then secured by pulling the free end through the locking head to simultaneously tighten these loops around the detainee's wrists. The FIG. 1 configuration thus avoids the need for a single loop of the strap to encircle both wrists of a detainee.

Another form of disposable handcuff avoiding a single loop is exemplified by U.S. Pat. No. 5,159,728 to Bingold. This handcuff includes a central locking head having two distinct apertures and two separate straps extending from the head. In use, each strap is irreversibly inserted into one of the apertures, thereby forming two separate loops in which a detainee's wrists are respectively placed. While this handcuff permits the two loops to be individually adjustable, somewhat alleviating the problem of properly applying the handcuff, it requires molding a head that is more intricate and complex than that used in a conventional cable tie. In addition, securing a detainee in the Bingold handcuff requires two operations, as each wrist must be secured independently. The resulting extra time and complexity is detrimental in many situations, e.g. one in which a subject actively resists his apprehension or the arresting officer must deal rapidly with multiple persons to be detained.

Furthermore, it has been found in field use that conventional disposable handcuffs, including those of the types disclosed by the foregoing patents, may be defeated by a determined detainee. By contorting their arms or wrists, detainees in some instances are able to exert sufficient force on the strap portion to cause the locking head mechanism to fail, thereby permitting the strap to be withdrawn partly or completely, so that the detainee would no longer be restrained. The resulting danger to both law enforcement personnel and the general public is clear.

A number of disclosures in the cable tie art are directed to improving the strength of engagement between the strap portion and the locking head in order to increase resistance to inadvertent withdrawal of the strap. Representative disclosures include those of U.S. Pat. No. 5,146,654 to Caveney et al., U.S. Pat. No. 5,193,251 to Fortsch; and U.S. Pat. No. 5,513,421 to Wells. However, these improvements have not found application in a practical handcuff system.

Consequently, there remains a need for a disposable handcuff that is inexpensive to construct, light in weight, and readily and securely applied to a detainee, while not posing any unacceptable risk to the detainee.

SUMMARY OF THE INVENTION

In its various aspects, the present invention provides a disposable handcuff system and a method for its use to restrain the limbs of a subject. Generally stated, the system comprises: (i) a flexible tie comprising a locking head and an elongated, substantially planar strap extending from the locking head, and (ii) a locking sleeve having a sleeve slot and at least one unidirectional sleeve stop projecting into the sleeve slot. The strap comprises an intermediate engagement portion and terminates in a distal end portion. The locking head has a passageway configured to accommodate insertion of the flat strap in an insertion direction through the passageway and further comprises at least one unidirectional latching stop that projects into the passageway and is adapted for cooperative engagement with the intermediate engagement portion to prevent the strap from being withdrawn from the locking head in a removal direction opposite the insertion direction after the engagement. The handcuff system is configured to be applied to the wrists of a subject being restrained by inserting the distal end of strap into the passageway in the locking head to form a loop; encircling the wrists of the subject within the loop; drawing the strap to tighten the loop to an extent such that the person's wrists are securely restrained; and inserting the end of the strap emergent from the locking head through the sleeve slot of the locking sleeve. Both the latching stop and the sleeve stop are adapted to cooperate with the intermediate engagement portion to prevent the withdrawal of the strap from the locking sleeve and the locking head in a removal direction opposite the insertion direction. Preferably, the locking sleeve is cinched into abutment with the locking head, thereby providing a double locking action and increasing the force that would be required to defeat both stops and permit the strap to be withdrawn. The present handcuff system can likewise be employed to shackle the ankles of a subject by applying it in the same manner.

Preferably, the handcuff system further comprises a loop separator such as a ring through which the loop is passed, whereby the loop is divided into two sub-loops. In this configuration, each of the sub-loops is appointed to encircle one of the wrists of the detainee.

In another aspect, there is further provided a method for restraining a person's wrists, comprising: (i) providing a flexible tie comprising a locking head and an elongated, substantially flat strap extending from the locking head, the strap comprising an intermediate engagement portion and terminating in a distal end portion, the locking head having a passageway configured to accommodate insertion of the flat strap in an insertion direction through the passageway, and the locking head further comprising at least one unidirectional latching stop projecting into the passageway and adapted for cooperative engagement with the intermediate engagement portion to prevent the strap from being withdrawn from the locking head in a removal direction opposite the insertion direction after the engagement, when the strap is drawn through the locking head to an extent such that the person's wrists are restrained by the handcuff system; (ii) inserting the strap in the insertion direction through the passageway to form a loop; (iii) placing the person's wrists within the loop and drawing the strap through the locking head to an extent sufficient that the person's wrists are restrained by the handcuff system; and (iv) installing a locking sleeve onto a portion of the strap emergent from the locking head, the locking sleeve having at least one sleeve stop adapted for cooperative engagement with the intermediate engagement portion to inhibit withdrawal of the strap from the locking sleeve in a removal direction opposite the insertion direction after the engagement. Preferably, the locking sleeve is cinched into abutment with the locking head. It is preferred that the method further include separating the loop formed in step (b) into two sub-loops, and wherein one of the person's wrists is restrained within each sub-loop of the loop.

The present handcuff system is light in weight and simple to operate. A suspect is readily released at an appropriate time by use of a simple cutting tool to sever the strap. The low cost of the system renders it disposable after use. A police officer or other user of the handcuff system can readily carry multiple handcuffs on his person or in a squad car for use in situations wherein multiple suspects must be detained in a short period of time. The handcuff system affords reliable restraint while minimizing danger to the suspect because of incorrect application. The use of the locking sleeve to supplement the latching function of the flexible tie locking head markedly improves the resistance of the handcuff system to being defeated by a suspect.

BRIEF DESCRIPTION OF THE DRAWINGS

The invention will be more fully understood and further advantages will become apparent when reference is had to the following detailed description of the preferred embodiments of the invention and the accompanying drawings, wherein like reference numeral denote similar elements throughout the several views and in which.

DESCRIPTION OF THE PREFERRED EMBODIMENTS

Figure 1:
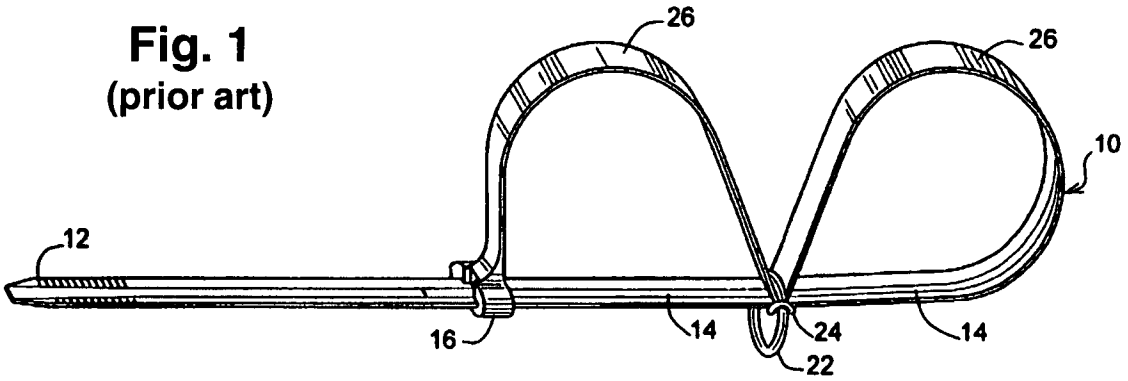
Fig. 1 (prior art)
FIG. 1 is a perspective view of a prior art disposable handcuff.
Figure 2:
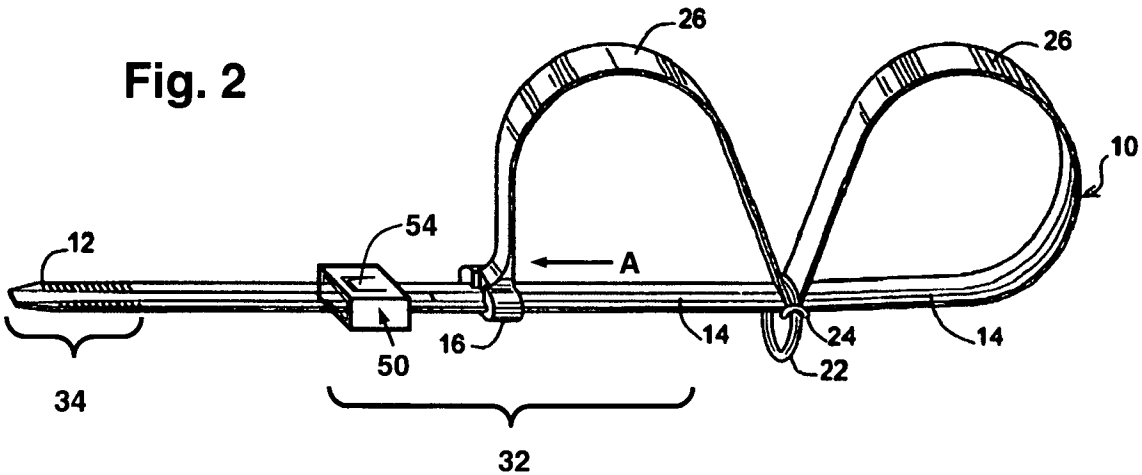
FIG. 2 is a perspective view of one form of a disposable handcuff system of the present invention.

FIG. 2 illustrates generally at 10 one possible implementation of the present disposable handcuff system. Handcuff system 10 comprises a flexible tie comprising a locking head 16 and an elongated, substantially planar strap 14 that extends from locking head 16 and has first and second opposed surfaces. The strap includes an intermediate engagement portion 32 and terminates in a distal end or tip portion 34. Locking head 16 is configured with a passageway that extends through the head and has dimensions that accommodate insertion of strap 14 in the direction indicated by the arrow labeled with reference letter A. A unidirectional latching stop projecting into the passageway engages the strap and inhibits its removal. Handcuff system 10 further includes locking sleeve 50 to augment its security, by increasing the force needed to overcome the resistance provided in concert by locking sleeve 50 and locking head 16 to inhibit substantial movement of the strap in a withdrawal direction opposite insertion direction A.

Handcuff system 10 is configured for its appointed use by first inserting the distal end 12 of strap 14 through the terminal locking head 16 to form a loop. The insertion is made in an insertion direction indicated by arrow A. As further apparent from FIG. 2, the loop then formed into two sub-loops 26 by a loop separator, such as open ring 22. Each of the sub-loops is appointed for securing one of the wrists of the person being detained. Ring 22 is sized large enough that two thicknesses of strap slide readily through its opening, but small enough to ensure that the sub-loops remain distinct during handcuff use and that the each sub-loop embraces almost all of the detainee's corresponding wrist after the handcuff system is fully secured. Although ring 22 is shown as being circular, other shapes may also be used, such as elliptical or rectangular, as long as the two layers of strap may slip freely through the ring's opening.

Application of handcuff system 10 is completed by first drawing enough of the strap 14 through locking head 16 and ring 22 to tighten both the sub-loops around the detainee's wrists, with the ring remaining between. Locking sleeve 50 is applied over tip portion 34 emergent from locking head 16 and drawn into abutment with locking head 16. Once the strap is tightened and the latching stop engages the strap in the intermediate engagement portion, it cannot be loosened substantially by withdrawing it from the locking head. The latching stops of locking head 16 and locking sleeve 50 both act to resist withdrawal of strap 14 after the handcuff system is applied to secure a detainee.

It will be understood that while the present disposable handcuff system is herein described as being used to restrain the wrists of a detainee, it is equally useful in restraining a subject's ankles. Therefore, references herein and in the subjoined claims to the application of handcuffs to a subject's wrists are to be understood as comprising application to a subject's ankles as well.

For convenience, the handcuff system may be prepared in a ready position in which strap 14 is drawn through locking head 16 to an extent such that positioning ring 22 approximately in the center of the large loop creates the sub-loops 26 of a size that facilitates slipping the handcuff system over a detainee's hands and onto the wrists, while minimizing the amount of slack that must be further pulled through locking head 16 to properly tighten the cuffs to provide a secure placement. In the ready position of handcuff system 10, ring 22 is preferably maintained in its central position by a retaining means 24 slipped over and around the ring 22, thereby revealing an open loop portion of the ring 22 that may conveniently be grasped. Optionally, for ease of storage, the two sub-loops may be folded together at the ring location and the retaining means or a supplemental retaining means centrally located in the now-adjoining sub-loops to maintain the folded configuration. Locking sleeve 50 may also be pre-applied by sliding it onto the free end of strap 14, disposing it at least beyond tip portion 34. It will be understood that the foregoing preparation is feasible for the handcuff application, whereas a cable tie appointed for securing a wire bundle lacking any defined end cannot be prepared in any closed loop before application.

Retaining means 24 is preferably provided by a rubber or other elastomeric O-ring, but other structures, such as a rubber band or a breakaway closure of plastic, cardboard, or the like, may also be employed.

Figure 3:
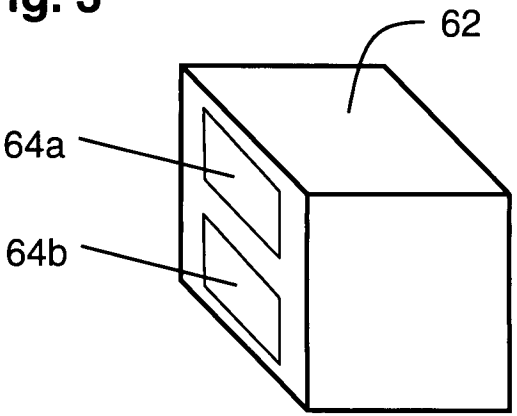
FIG. 3 is a perspective view of a loop separator used in one form of the present disposable handcuff system.

As an alternative to a ring having a single aperture, as shown in FIG. 2, the present handcuff system may alternatively employ a loop separator of the type shown at 62 in FIG. 3, in which two through channel slots 64*a*, 64*b* are provided, so that the strap passes once through each slot, again creating the two sub-loops 26. Although depicted in FIG. 3 as having a generally rectangular prismatic overall shape, separator 62 can also have sides that are curved to conform more closely to the shape of a human wrist. Slots 64*a*, 64*b* can be in close proximity as shown, or separated by any distance, as long as the restraint function is maintained. The through directions of slots 64*a*, 64*b* may be generally parallel as shown or configured at another angle. Separator 62 can be made of plastic or metal by stamping, casting, extrusion, or other suitable process.

Components of the handcuff system may optionally be supplied as a kit, comprising the flexible tie with locking head and strap, loop separator, locking sleeve, and, optionally, the retaining means. These items may subsequently be assembled as described above to form the handcuff in the ready position. The system may also be assembled at the point of use.

The tie is preferably composed of any suitable commodity or engineering plastic. More preferably, the tie is integrally molded using a suitable nylon. The plastic tie material may comprise reinforcing fibers of glass, graphite, or other material appointed to increase its strength or otherwise beneficially modify its properties.

Several forms of unidirectional, locking engagement between the locking head and the strap portion are employed in conventional cable ties. Two commonly used forms involve a locking head that employs either: (i) an angulated metal barb that penetrates the strap to create a biting, unidirectional engagement or (ii) a deflectably-mounted pawl that engages any of a series of closely-spaced, complementary teeth formed in one surface of the strap. See, e.g., U.S. Pat. No. 6,507,979 to Thompson and U.S. Pat. No. 5,193,254 to Geisinger, respectively, which are both incorporated herein in the entirety by reference thereto. The dimensions of the strap and the locking head passageway and the placement of the locking stop therein are chosen so that the strap is readily inserted during placement and tightening of the handcuff system on the detainee's wrists, while not providing excess play that could compromise secure unidirectional engagement thereafter. Any of the foregoing or other forms of engagement are suitably employed in the present handcuff system to provide the required unidirectional locking functionality. Preferably, the same form of engagement is used in both the locking head and the supplemental locking sleeve.

The metal barb used in some embodiments of the locking head is frequently provided as a small piece of flat metal, such as a stainless steel alloy, that is molded into and secured by the head housing, with a free bare end extending into the through passageway. As mounted, the barb is sufficiently flexible for the free strap end to be inserted and tightened to the requisite extent. The angle between the barb and the insertion direction chosen is such that initial strap insertion is not markedly impeded, while thereafter permitting the barb to pierce the strap slightly to create a biting engagement that impedes withdrawal of the strap in the opposite direction.

Alternatively, the locking stop is provided in plastic locking head embodiments by a deflectable pawl that preferably is integrally molded in the head or otherwise provided as a separate workpiece ultimately assembled into the head. Preferably, the pawl has teeth configured to unidirectionally engage complementary teeth in the strap in a ratchet-like fashion.

As depicted in FIG. 2, the handcuff system further includes a locking sleeve 50 that augments the security of the handcuff closure by increasing resistance to withdrawal of the strap. By cinching locking sleeve 50 into abutment with the locking head 16, withdrawal of strap 14 requires application of enough force to make the locking mechanisms of both head 16 and sleeve 50 fail simultaneously. Placing the locking sleeve into abutment also impedes any attempt to pick the locking head by inserting a blade or like tool to disengage the locking stop from the strap. The present handcuff system thus is far more secure against attempts to defeat it, enhancing the safety of both the public and the arresting officer.

Figure 5:
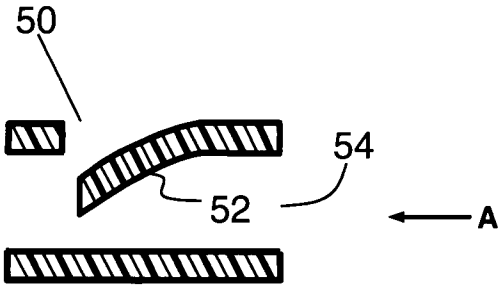
FIG. 5 is a cross-sectional view of the locking sleeve of FIG. 4 taken at V-V.
Figure 4:
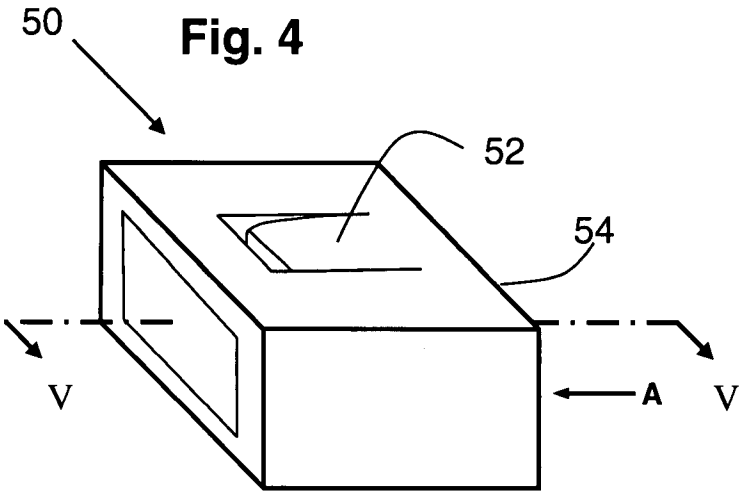
FIG. 4 is a perspective view of one form of locking sleeve used in an embodiment of the present disposable handcuff system.

The form of locking sleeve illustrated generally in FIG. 2 and in greater detail in FIGS. 4-5 has a through sleeve slot 54 and a unidirectional sleeve stop, such as barb 52. Locking sleeve 50 is installed on the portion of strap 14 that emerges from the locking head 16, thereby augmenting the resistance of handcuff system 10 to defeat by a detainee. As noted above, there have been instances in which determined detainees have been able to defeat conventional disposable handcuffs by imposing enough force urging withdrawal of the strap from the locking head to cause the locking mechanism to slip or fail completely. Once the handcuff restraint is removed, the detainee is likely to attempt escape or to endanger the arresting officer.

Figure 6:
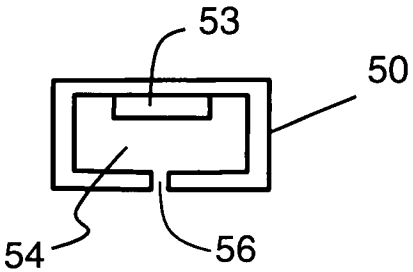
FIG. 6 is an end elevational view of one form of locking sleeve used in the present disposable handcuff system.

Locking sleeve 50 may be constructed of any suitable material, including plastics and metals. Any suitable forming technique, including casting, molding, extrusion, and stamping may be used. As best seen in FIG. 6, the embodiment 50 also shown in FIGS. 2 and 4-5 is readily formed from sheet metal stock by a stamping operation, which cuts a preselected length of flat sheet stock and bends it to create four right-angle corners and a generally rectangular configuration with a through slot forming a channel. The shearing to length preferably is done before the slot is formed. A bottom seam 56 may be left open as shown or joined by any suitable metal joining technique. A punching operation, preferably carried out before the sheet is folded into its rectangular configuration, is used to create a tongue 53 that projects into the slot 54 created by the bending operation. A generally rectangular tongue 53 is created by making cuts on three sides of the top face of sleeve 50. Thereafter, the tongue portion is bent so that it projects into the slot channel in the desired configuration to provide a locking stop for reliable cooperative engagement with the strap.

Figure 7:
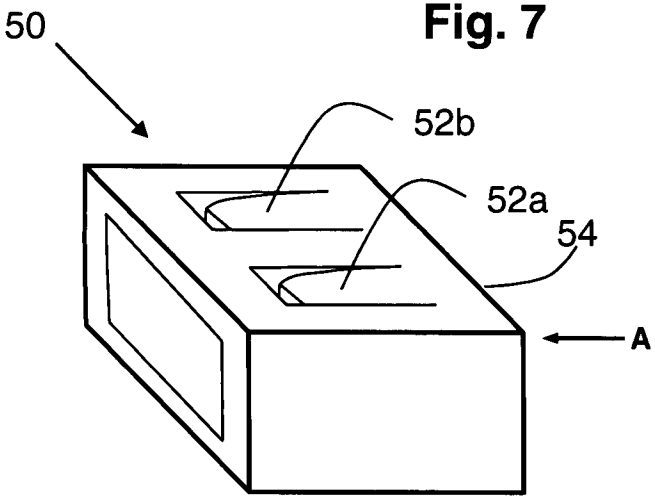
FIG. 7 is a perspective view of another form of locking sleeve used in an embodiment of the present disposable handcuff system.
Figure 8:
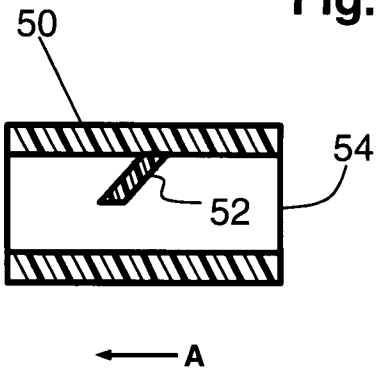
FIGS. 8-10 are cross-sectional views of alternative forms of locking sleeve used in the present disposable handcuff system

It will also be understood that tongues of other shapes may be employed. For example, a two-sided cut, with the cut lines meeting at an acute angle, may be used to create a pointed tongue or barb. The punching is arranged so that the tongue projects into the slot to an extent that permits the strap to be drawn through initially, while thereafter forming a biting engagement that pierces the strap surface, thereby providing resistance to withdrawal of the strap in a withdrawal direction opposite the insertion direction. As shown in FIG. 7, a dual punching may be used to provide two barb elements 52*a*, 52*b* that separately engage strap 14. The barbs may be side-by-side, as shown in FIG. 7, or displaced along the length of the strap. Alternatively, stops are placed on the bottom, top, or sides of the sleeve. In other embodiments, barb 52 is cast integrally as part of sleeve 50, as seen in FIG. 8.

Embodiments of the locking sleeve may also be formed of molded plastic. The unidirectional engagement of plastic locking sleeves may involve either at least one deflectable pawl or one or more barbs either molded directly into the plastic or provided by a small piece of thin metal disposed at an acute angle.

For embodiments of the present system in which the locking head and locking sleeve both have a locking stop provided by a deflectable pawl, the strap preferably includes a column of teeth extending at least over the length of the intermediate engagement portion 34 and the pawl is preferably configured with complementary teeth to engage the strap teeth. Each strap tooth is oriented in a direction across the width of the strap and on the side the pawl engages. If two side by side deflectable pawls are present in the locking head, either a single column of teeth wide enough to accommodate both pawls may be used, or a second column of teeth paralleling the first column may be provided, such that each pawl engages teeth of one of the columns.

Embodiments providing engagement by either dual deflectable pawls or a dual barb beneficially improve the security of the handcuff system. Attempts to defeat the engagement by inserting a thin blade or tool that lifts the pawl or barb are unlikely to be effective, because both pawls or barbs must be defeated simultaneously.

The distal tip portion 34 of the strap is preferably tapered in width to facilitate its initial insertion into head 16. In addition, serrations, embossing, holes, or other tactile surface features are beneficially present in the tip portion to permit it to be securely gripped. Preferably, the tapering and surface features extent for a distance several times the length of the insertion passageway of head 16. This configuration permits portion 34 to be inserted far enough through the locking head so that the portion emerging can be grasped readily for tightening the handcuffs securely around a detainee's wrists.

The strap is appointed for cooperative engagement with the locking stop and locking head at any point along intermediate engagement portion 32, which preferably encompasses a sufficient portion of the linear extent of strap 14 to accommodate the range of sizes of normal human wrists or ankles. Thus, the intermediate engagement portion preferably extends fully from the locking head 16 to the distal end portion 34. However, it is possible for some portion near the locking head and near the distal end not to be appointed for engagement, while still maintaining the full functionality of the handcuffs for their normal use.

The present locking sleeve may be used to augment the resistance of other known disposable handcuffs to being defeated. For example, the handcuff of U.S. Pat. No. 5,159,728 employs two independently operable straps and locking heads. The functionality of this handcuff may be improved by using one of the present locking sleeves on each of the straps. The locking sleeve may also be used in conjunction with cable ties used in the electrical and building trades.

Figure 9:
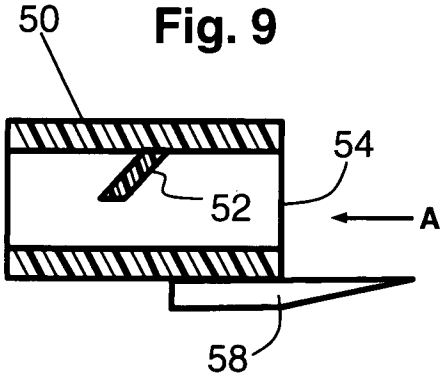
Figure 10:
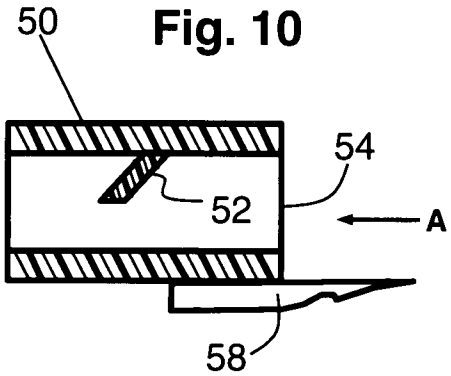

In another form, as depicted by FIGS. 9-10, locking sleeve 50 includes a wedge 58 or other means appointed to increase still further the resistance of the present handcuff system to withdrawal of the handcuff strap. Wedge 58 is adapted to be driven between the strap and the bottom wall of the locking head passageway when the locking sleeve is jammed into close abutment with the locking head. The wedge thus provides additional protection against withdrawal of the strap when the present handcuff system is applied, by increasing frictional resistance between the strap and the walls locking head passageway, providing pressure against and support for the locking stop to prevent disengagement, or both. Preferably, the optional wedge 58 is serrated as shown in FIG. 10 to further enhance the frictional engagement.

Having thus described the invention in rather full detail, it will be understood that such detail need not be strictly adhered to, but that additional changes and modifications may suggest themselves to one skilled in the art. All alternative combinations of two or more of the individual features mentioned or evident from the foregoing description and the accompanying drawings constitute aspects of the present invention, and fall within the scope of the invention as defined by the subjoined claims.

What is claimed is:

1. A disposable handcuff system for restraining a person's wrists, consisting of:

a) a flexible tie comprising a locking head and an elongated, substantially planar strap extending from the locking head, the strap comprising an intermediate engagement portion and terminating in a distal end portion, the locking head having a passageway configured to accommodate insertion of the strap in an insertion direction through the passageway, and the locking head further comprising at least one unidirectional latching stop projecting into the passageway and adapted for cooperative engagement with the intermediate engagement portion to prevent the strap from being withdrawn from the locking head in a removal direction opposite the insertion direction after the engagement, when the strap is drawn through the locking head to an extent such that the person's wrists are restrained by the handcuff system;

b) a locking sleeve consisting of a sleeve slot and at least one unidirectional sleeve stop projecting into the sleeve slot, the locking sleeve being configured to be installed onto a portion of the strap emergent from the locking head and the sleeve slot being configured to receive the strap in said insertion direction through the sleeve slot, and the sleeve stop being adapted for cooperative engagement with the intermediate engagement portion to inhibit withdrawal of the strap from the locking sleeve in said removal direction opposite the insertion direction after the engagement;

c) a loop separator configured to subdivide a loop formed by inserting the strap into the locking head into two sub-loops, one of the sub-loops being located on each side of the loop separator, and each sub-loop being appointed for securing one of the person's wrists; and d) said tie is composed of an integrally molded nylon.

2. The disposable handcuff system as recited by claim 1, wherein at least the intermediate engagement portion comprises at least one column of ratchet teeth and the sleeve stop comprises at least one pawl configured to engage the ratchet teeth, whereby withdrawal of the strap from the locking sleeve in the removal direction is inhibited.

3. The disposable handcuff system as recited by claim 1, wherein the loop separator comprises a ring having a single aperture.

4. The disposable handcuff system as recited by claim 1, wherein the loop separator comprises two apertures, and the strap passes once through each of the apertures.

5. In a disposable handcuff system for restraining a person's wrists, consisting of a flexible tie comprising a locking head and an elongated, substantially planar strap extending from the locking head, the strap comprising an intermediate engagement portion and terminating in a distal end portion, and wherein the locking head has a passageway configured to accommodate insertion of the strap in an insertion direction through the passageway and the locking head further comprises at least one unidirectional latching stop projecting into the passageway and adapted for cooperative engagement with the intermediate engagement portion to prevent the strap from being withdrawn from the locking head in a removal direction opposite the insertion direction after the engagement, when the strap is drawn through the locking head to an extent such that the person's wrists are restrained by the handcuff system, the improvement . wherein:

the handcuff system further comprises a locking sleeve consisting of a sleeve slot and at least one unidirectional sleeve stop projecting into the sleeve slot, the sleeve being configured to receive the strap in said insertion direction through the sleeve slot, and the sleeve stop being adapted for cooperative engagement with the intermediate engagement portion to inhibit withdrawal of the strap from the locking sleeve in said removal direction opposite the insertion direction after the engagement;

the handcuff system further comprising a loop separator configured to subdivide a loop formed by inserting the strap into the locking head into two sub-loops, one of the sub-loops being located on each side of the loop separator, and each sub-loop being appointed for securing one of the person's wrists; and said tie is composed of an integrally molded nylon.

6. For use in a disposable handcuff system for restraining a person's wrists, consisting of a flexible tie comprising a locking head and an elongated, substantially planar strap extending from the locking head, the strap comprising an intermediate engagement portion and terminating in a distal end portion, and wherein the locking head has a passageway configured to accommodate insertion of the strap in an insertion direction through the passageway:

a locking sleeve consisting of a sleeve slot and at least one unidirectional sleeve stop projecting into the sleeve slot, the locking sleeve being configured to be installed on a portion of the strap emergent from the locking head and the sleeve slot being configured to receive the strap in said insertion direction through the sleeve slot, and the sleeve stop being adapted for cooperative engagement with the intermediate engagement portion to inhibit withdrawal of the strap from the locking sleeve in a removal direction opposite the insertion direction after the engagement;

further comprising a loop separator configured to subdivide a loop formed by inserting the strap into the locking head into two sub-loops, one of the sub-loops being located on each side of the loop separator, and each sub-loop being appointed for securing one of the person's wrists; and said tie is composed of an integrally molded nylon.

7. In a flexible cable tie consisting of a locking head and an elongated, substantially planar strap extending from the locking head, the strap comprising an intermediate engagement portion and terminating in a distal end portion, and wherein the locking head has a passageway configured to accommodate insertion of the strap in an insertion direction through the passageway and the locking head further comprises a unidirectional latching stop projecting into the passageway and adapted for cooperative engagement with the intermediate engagement portion to prevent the strap from being withdrawn from the locking head in a removal direction opposite the insertion direction after the engagement, the improvement wherein:

the cable tie further comprises a locking sleeve consisting of a sleeve slot and at least one unidirectional sleeve stop projecting into the sleeve slot, the sleeve being configured to receive the strap in said insertion direction through the sleeve slot, and the sleeve stop being adapted for cooperative engagement with the intermediate engagement portion to inhibit withdrawal of the strap from the locking sleeve in said removal direction opposite the insertion direction after the engagement;

further comprising a loop separator configured to subdivide a loop formed by inserting the strap into the locking head into two sub-loops, one of the sub-loops being located on each side of the loop separator, and each sub-loop being appointed for securing one of the person's wrists; and said tie is composed of an integrally molded nylon.

* * * * *